United States Patent [19]

Ochsner

[11] Patent Number: 4,520,245

[45] Date of Patent: May 28, 1985

[54] DIFFERENTIAL PRESSURE OPERATED ELECTRICAL SWITCH CONSTRUCTION

[75] Inventor: Rolf H. Ochsner, Trumbull, Conn.

[73] Assignee: Robertshaw Controls Company, Richmond, Va.

[21] Appl. No.: 536,305

[22] Filed: Sep. 27, 1983

[51] Int. Cl.[3] ..... H01H 35/38

[52] U.S. Cl. ..... 200/82 R; 200/83 R; 200/283

[58] Field of Search ..... 200/82 C, 82 R, 83 A, 200/83 P, 283, 284, 83 R, 81 R

[56] References Cited

U.S. PATENT DOCUMENTS

| | | | |
|---|---|---|---|
| 3,153,708 | 10/1964 | Guthrie | 200/82 X |
| 3,457,384 | 7/1969 | Topfer et al. | 200/82 R X |
| 3,546,667 | 12/1970 | Thomas | 200/82 R X |
| 3,621,167 | 11/1971 | Burke | 200/82 R |
| 3,924,086 | 12/1975 | Ochsner | 200/82 R |
| 4,215,254 | 7/1980 | Ohki | 200/82 R X |

*Primary Examiner*—G. P. Tolin

*Attorney, Agent, or Firm*—Candor, Candor & Tassone

[57] ABSTRACT

A differential pressure operated electrical switch construction and method of making the same are provided, the construction having a housing carrying a pair of substantially straight parallel terminals and an electrical switch for electrically interconnecting the terminals together under the control of an actuator that is responsive to differential pressure acting across the same. One of the terminals has an end provided with a substantially rectangular opening passing transversely and completely therethrough and defining a substantially straight interior edge of the one terminal and the switch includes a movable switch blade having one end carried by the other of the terminals and having another end disposed in the opening for engaging against the edge to thereby place the terminals in electrical contact with each other.

13 Claims, 7 Drawing Figures

DIFFERENTIAL PRESSURE OPERATED ELECTRICAL SWITCH CONSTRUCTION

BACKGROUND OF THE INVENTION

1. Field of the Invention

This invention relates to an improved differential pressure operated electrical switch construction and to a method of making the same as well as to the use of such electrical switch construction in combination with a refrigerant compressor.

2. Prior Art Statement

It is known to provide a differential pressure operated electrical switch construction having a housing means carrying a pair of rigid terminals and an electrical switch means for electrically interconnecting the terminals together when the switch means is in one operating condition thereof and for electrically disconnecting the terminals from each other when the switch means is in another operating condition thereof, the housing means having actuator means responsive to differential pressure acting across the same and being operatively associated with the switch means to place the switch means in one condition thereof when having a certain differential pressure acting across the same and to place the switch means in the other condition thereof when having another certain differential pressure acting across the same. For example, see the U.S. Pat. No. 3,924,086, to Ochsner, wherein it appears that the switch means comprises a sealed reed switch that is operated by a magnet means of the actuator moving relative to the sealed reed switch.

It was suggested by another that it would be desirable to have a pressure differential operated electrical switch construction that could be mounted in a bore of the oil pump casting for a refrigerant compressor so that the need for capillary tubing could be eliminated. However, no structure was suggested for accomplishing such a desired result.

SUMMARY OF THE INVENTION

It is a feature of this invention to provide an improved differential pressure operated electrical switch construction wherein the need for capillary tubing is eliminated.

In particular, it was found that the prior known electrical switch construction that senses oil pressure as set forth in the aforementioned U.S. Pat. No. 3,924,086, to Ochsner, is subject to failure because of having the capillary tubing thereof easily broken whereby it was desired to provide an oil pressure sensing switch construction that does not need to have capillary tubing and which could be mounted in a bore of the apparatus having the lubricant system thereof monitored by such differential pressure operated electrical switch construction.

Accordingly, it was found according to the teachings of this invention that a switching means for electrically connecting and disconnecting the terminals of the switch construction could be uniquely formed to operate in the high pressure sensing chamber thereof.

For example, one embodiment of this invention provides a differential pressure operated electrical switch construction having a housing means carrying a pair of rigid substantially straight parallel terminals and an electrical switch means for electrically interconnecting the terminals together when the switch means is in one operating condition thereof and for electrically disconnecting the terminals from each other when the switch means is in another operating condition thereof, the housing means having actuator means responsive to differential pressure acting across the same and being operatively associated with the switch means to place the switch means in the one condition thereof when having a certain differential pressure acting across the same and to place the switch means in the other condition thereof when having another certain differential pressure acting across the same. One of the terminals has an end provided with a substantially rectangular opening passing transversely and completely therethrough defining a substantially straight interior edge means of the one terminal and the switch means comprises a movable switch blade having one end carried by the other of the terminals and having another end disposed in the opening for engaging against the edge means and thereby place the switch means in the one condition thereof and for being out of engagement with the edge means and thereby place the switch means in the other condition thereof.

Accordingly, it is an object of this invention to provide an improved differential pressure operated electrical switch construction having one or more of the novel features of this invention as set forth above or hereinafter shown or described.

Another object of this invention is to provide a method of making such a differential pressure operated electrical switch construction, the method of this invention having one or more of the novel features of this invention as set forth above or hereinafter shown or described.

Another object of this invention is to provide an improved combination of a refrigerant compressor and such differential pressure operated electrical switch construction, the combination of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
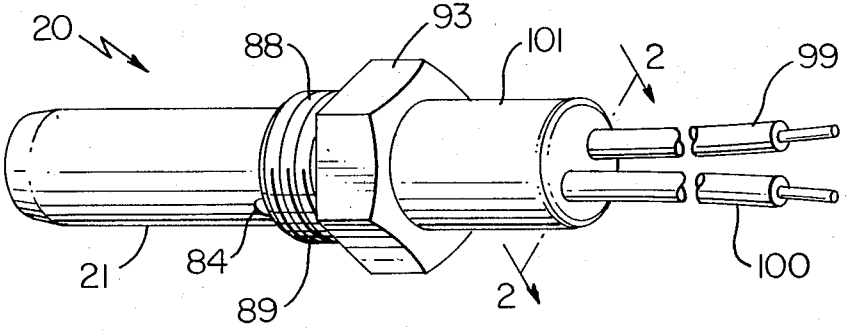
FIG. 1 is a perspective view of the differential pressure operated electrical switch construction of this invention.

While the various features of this invention are hereinafter illustrated and described as being particularly adapted to provide a differential pressure operated electrical switch construction for a compressor, it is to be understood that the various features of this invention can be utilized singly or in any combination thereof to provide a differential pressure operated electrical switch construction for other apparatus as desired.

Therefore, this invention is not to be limited to only the embodiment illustrated in the drawings, because the drawings are merely utilized to illustrate one of the wide variety of uses of this invention.

Referring now to FIGS. 1-6, the improved differential pressure operated electrical switch construction of this invention is generally indicated by the reference numeral 20 and comprises a housing means 21 that includes an elongated substantially cylindrical tubular member 22 formed of metallic material or the like and having opposed open ends 23 and 24.

A pair of plug members 25 and 26 are respectively disposed in the open ends 23 and 24 of the tubular member 22 to close the open ends 23 and 24, the plug members 25 and 26 respectively being formed of electrically insulating material, such as plastic material, and being secured in the tubular member 22 in any suitable manner, such as by press-fitting, adhesive means, etc., or even by a turning over of the respective open end 23 and 24 over the same as illustrated by the swaged end portion 27 of the open end 23 for the plug member 25.

The plug member 26 carries a pair of substantially rigid and conductive terminals 28 and 29 that respectively have portions 30 and 31 molded or otherwise secured in the plug member 26 and respectively extend beyond opposed ends 32 and 33 of the plug member 26 while being inboard of the outer peripheral surface 34 of the plug member 26 so that the terminal members 28 and 29 are respectively electrically insulated from the tubular member 22.

The terminal members 28 and 29 respectively have outer ends 35 and 36 that extend outwardly beyond the surface 33 of the end plug 26 as well as beyond the open end 24 of the tubular member 22 to be interconnected into an electrical circuit (not shown) in a manner hereinafter set forth.

The other ends 37 and 38 of the terminals 28 and 29 respectively extend beyond the end 32 of the plug member 26 and define part of an electrical switch means that is generally indicated by the reference numeral 39 and is utilized to electrically interconnect the terminal members 28 and 29 together when the switch means 29 is in one condition thereof and for electrically disconnecting the terminals 28 and 29 from each other when the switch means 39 is in another operating condition thereof as will be apparent hereinafter.

The end 38 of the terminal 29 defines an enlarged substantially rectangular portion 40 that is wider than the body portion 41 of the terminal member 29 so that the same has a shoulder 42 that bears against the end surface 32 of the end plug 26 so as to prevent pulling out of the terminal member 29 relative to the end plug 26.

Likewise, the end 37 of the terminal member 28 can be slightly larger than the normal width of the body portion thereof so as to have a shoulder means bearing against the surface 32 to prevent the terminal 28 from being pulled out of the end plug 26 from the position thereof illustrated in the drawings.

Accordingly, the terminal members 28 and 29 are held in the position illustrated in the drawings by the plug member 26 so that the ends 37 and 38 cooperate together to provide the switch means 39 in a manner now to be described.

The electical switch means 39 includes a conductive resilient switch blade 43 having opposed ends 44 and 45, the switch blade 43 having the end 44 thereof secured to the end 37 of the terminal 28 and being bent to define an elbow portion 46 thereof so that the end 45 is adapted to be disposed in a substantially rectangular opening 47 formed through the end 38 of the terminal 29 and defining an interior edge means 48 thereof that is substantially rectangular as defined by spaced parallel edge portions 50 and 51 as well as by spaced parallel edge portions 52 and 53 which are disposed transverse to the edge portions 50 and 51 and join with the same in the manner illustrated in the drawings.

The natural resilience of the switch blade 43 is to place the end 45 thereof into electrical contact with the portion 50 of the edge means 48 of the terminal 29 and, in particular, with only the portion 50 on the side 54 of the terminal 29 that faces the side 55 of the terminal 28 as illustrated in the drawings because the opening 47 is so constructed and arranged that the edge 50 requires the switch blade 43 to have the end 45 disposed at an acute angle relative to the end 44 rather than at a right angle or an obtuse angle so that the end 45 will only bear against the edge means 50 adjacent the side 54 of the terminal 29 and not at the edge means 50 adjacent the other side 56 thereof. In this manner, the switch blade 43 can make substantially line contact with the edge portion 50 and, if the medial portion of the end 45 of the switch blade is contoured by the longitudinal rib 45' as illustrated in FIGS. 2, 3, 4 and 5, such ribs 45' will make point contact with the edge portion 50.

The switch blade 43 is relatively wide and is relatively long and has a dimple 57 formed in a medial portion 58 thereof for a purpose hereinafter described, the dimple 57 having an apex 57' facing away from the surface 32 of the plug member 26 and being adapted to be engaged by a substantially flat end surface 59 of an actuator means that is generally indicated by the reference numeral 60 in FIG. 2 and now to be described.

The actuator means 60 includes a movable piston means 61 that is disposed in the tubular housing member 22 and is adapted to separate the same into two chambers 62 and 63 because the same carries a flexible seal member 64 that seals against the internal peripheral surface 65 of the tubular member 22 while permitting axial movement of the piston member 61 therein.

In this manner, the chamber 62 is adapted to be interconnected to a low side of a pressure source and the chamber 63 is adapted to be interconnected to the high side of the pressure source so that the pressure differential acting across the piston 61 will cause the piston 61 to be positioned relative to the switch blade 43 and thereby cause the switch blade 43 to either electrically interconnect the terminals 28 and 29 together or to electrically disconnect the terminals 28 and 29 from each other as will be apparent hereinafter.

The piston means 61 can comprise a one-piece member or can comprise a plurality of parts as illustrated in the drawings. For example, the piston means 61 as illustrated comprises a substantially cylindrical member 66 which has a pair of piston members 67 and 68 respectively telescoped onto the opposed ends 69 and 70 thereof as illustrated with the piston members 67 and 68 being secured thereto in any suitable manner, such as being press-fit thereon, adhesively secured thereto, etc.

The piston member 67 has an annular disc-like flange 71 which acts as a spring retainer by defining an annular shoulder 72 against which one end 73 of a coiled compression spring 74 engages while the other end 75 thereof bears against an annular shoulder 76 on the plug member 25 as illustrated in the drawings whereby the force of the compression spring 74 tends to axially move the piston means 61 in a direction to cause opening of the switch blade 43 away from the contact edge portion 50 of the terminal 29 as will be apparent hereinafter.

Figure 2:
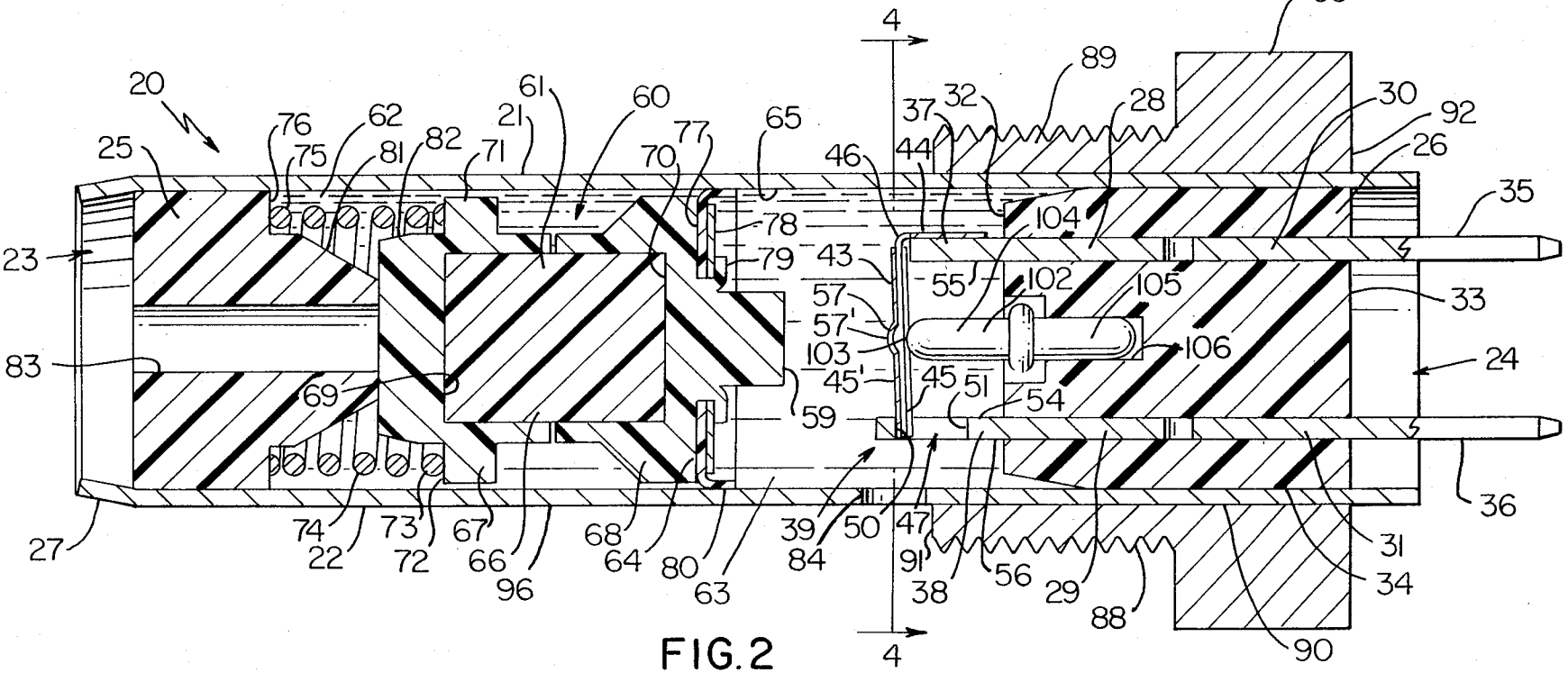
FIG. 2 is an enlarged cross-sectional view taken on line 2—2 of FIG. 1.
Figure 3:
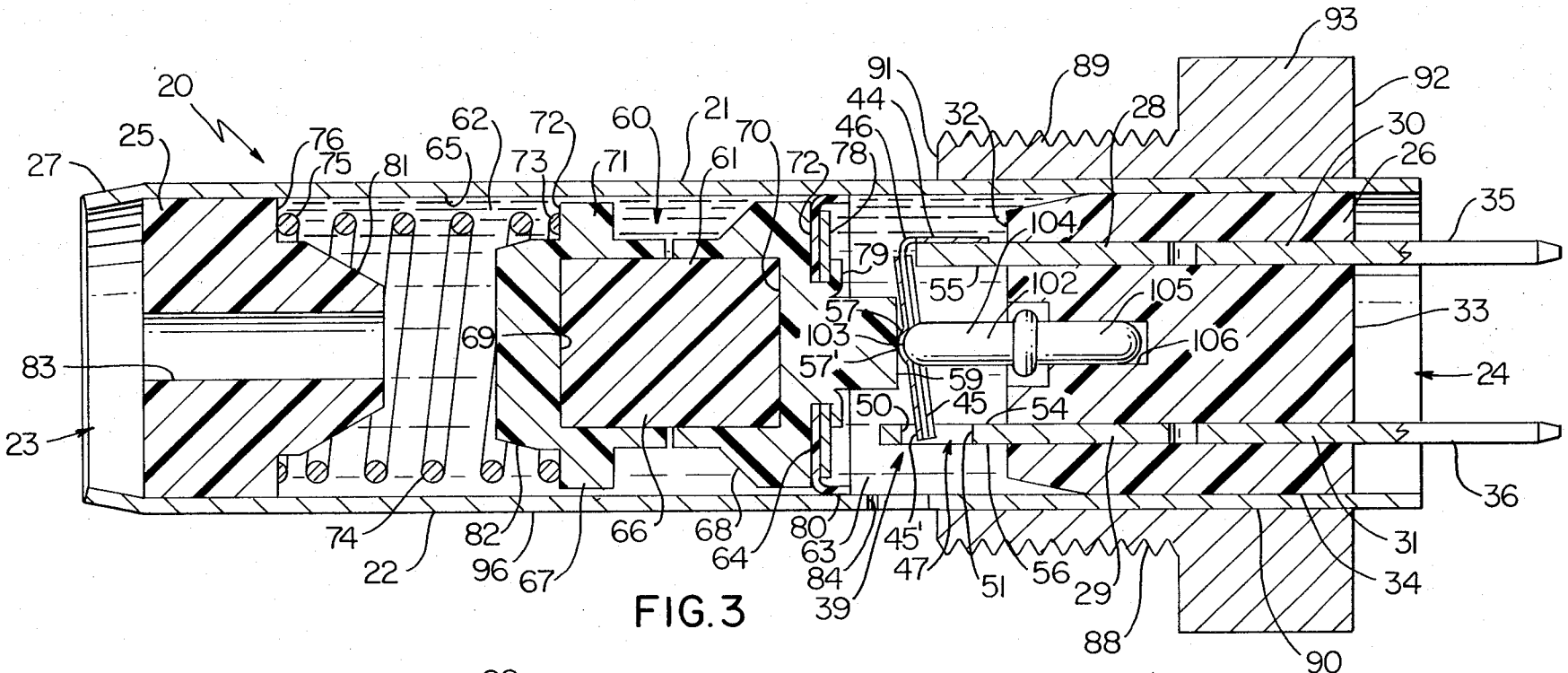
FIG. 3 is a view similar to FIG. 2 and illustrates the switch construction in another operating condition thereof.

The other piston part 68 carries the annular sealing member 64 and has an annular shoulder 77 against which the inner portion of the flexible sealing member 64 is held by a metallic washer-like member 78 which is placed against the sealing member 64 by a turned over portion 79 of the piston part 68 that is disposed inboard of the end surface 59 thereof as illustrated in FIGS. 2 and 3.

Because the annular sealing member 64 originally comprises a substantially annular flat disc, the same has the outer peripheral portion 80 thereof turned at a right angle to the metallic member 78 so as to wipe against the internal peripheral surface 65 of the tubular member 22 and seal against the same, particularly because the chamber 63 is the high pressure chamber or side relative to the chamber 62 whereby the high pressure fluid in the chamber 63 causes the turned portion 80 to be urged against the peripheral surface 65 of the tubular member 22 to seal against the same.

The piston parts 66, 67 and 68 are formed from any suitable electrically insulating material, such as a plastic material, so as to prevent electrical connection from the switch blade 43 to the tubular member 22.

As illustrated in FIGS. 2 and 3, the end plug or plug member has a nose-like portion 81 that is adapted to extend into the compression spring 74 so as to provide a spring locating means therefor, the piston part 67 likewise having a nose end portion 82 for extending outwardly beyond the annular surface 72 into the compression spring 74 to provide a spring locating means for the end 73 thereof.

The plug member 25 has an opening 83 passing substantially centrally and completely therethrough whereby the opening 83 in the end plug 25 interconnects the open end 23 of the tubular member 22 to the chamber 62 so that the chamber 62 is adapted to be fluidly interconnected to a low pressure source through the open end 23 of the tubular member 22.

The high pressure chamber 63 is adapted to be interconnected to a high pressure source by an opening 84 formed through the tubular member 22 as illustrated in FIGS. 2 and 3, the end plug or plug member 26 sealing the chamber 63 from the end 24 of the tubular housing member 22.

Figure 7:
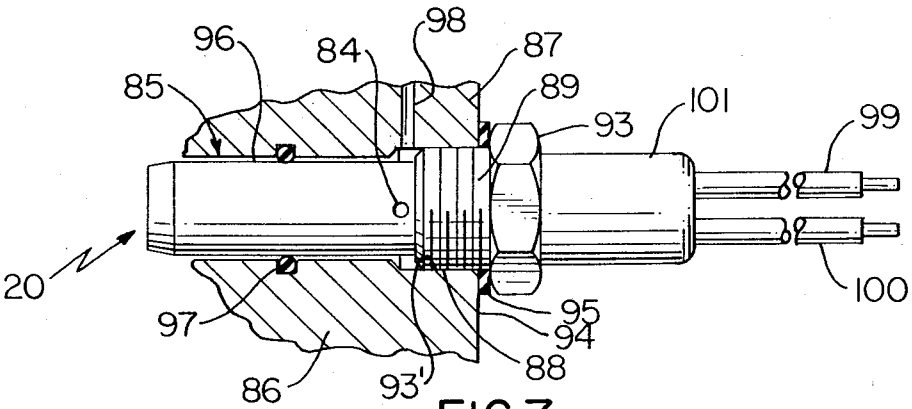
FIG. 7 is a reduced fragmentary view of the switch construction of this invention disposed in a compressor housing.
Figure 5:
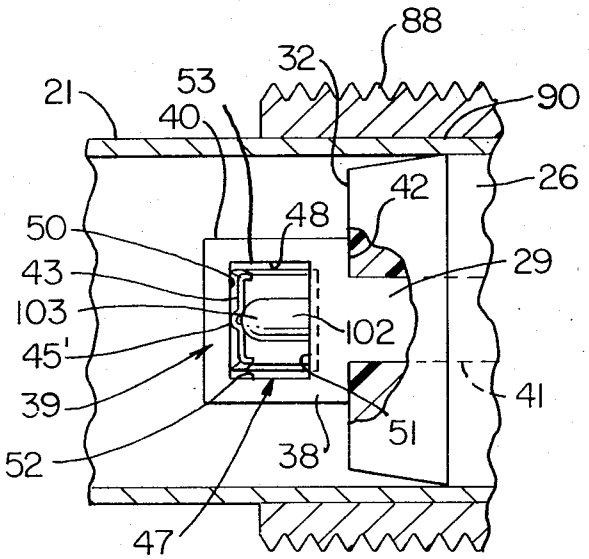
FIG. 5 is a fragmentary cross-sectional view of a portion of the switch construction of FIG. 2.
Figure 4:
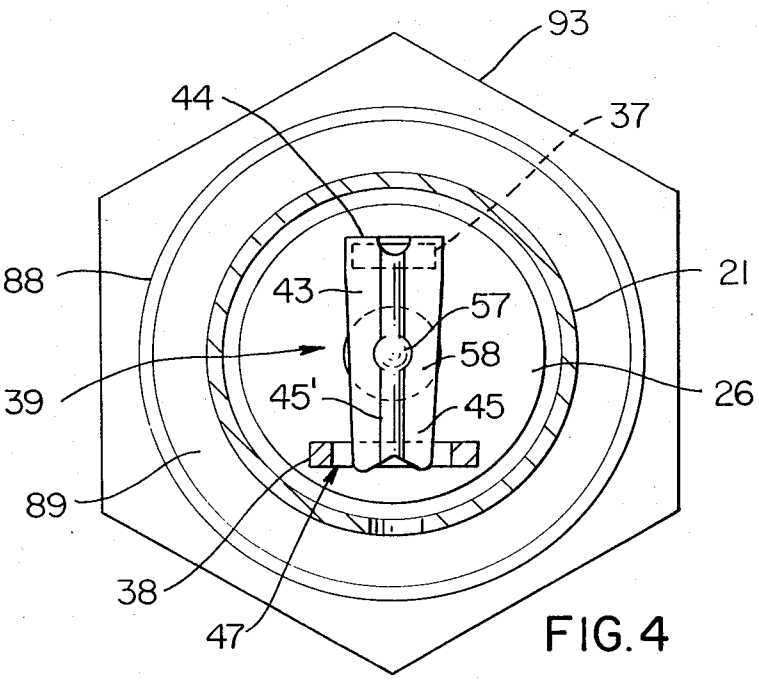
FIG. 4 is a cross-sectional view taken on line 4—4 of FIG. 2.
Figure 6:
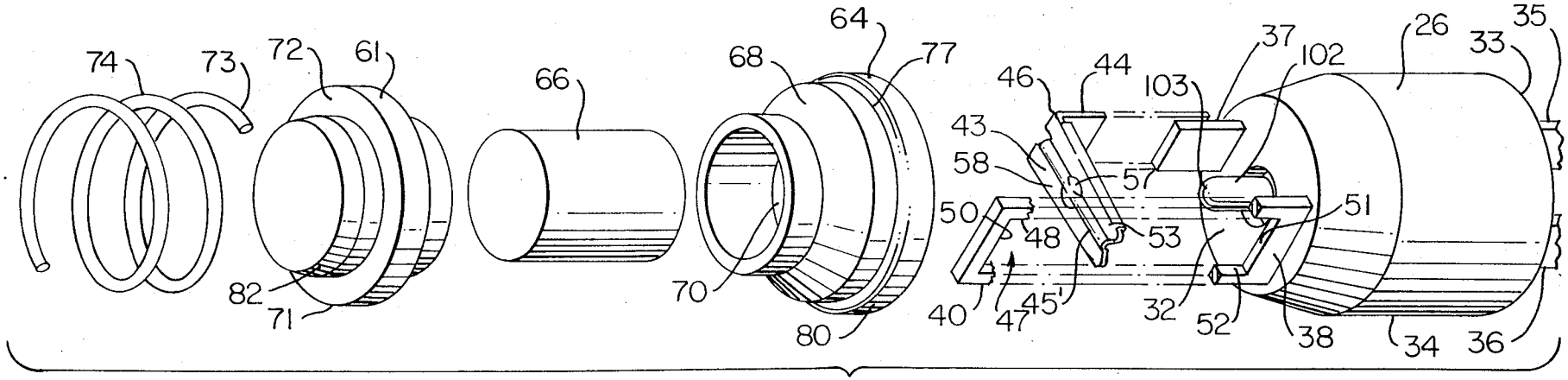
FIG. 6 is a reduced exploded perspective view of the switch construction of FIGS. 1–5.

In this manner, the differential pressure operated electrical switch construction 20 of this invention is adapted to be disposed in a passage means, that is generally indicated by the reference numeral 85 in FIG. 7, of a lubricant pump housing 86 of a refrigerant compressor 87 and be secured in such passage means 85 by an externally threaded portion 88 of a fastening member 89 that has the end 24 of the tubular member 22 disposed through an opening 90 passing through the opposed ends 91 and 92 of the fastening member 89 and being secured therein in any suitable manner, the external threads 88 of the fastening member 89 being threaded against internal threads 93′ formed in the passage means 85 of the housing 86 so that the enlarged portion 93 of the fastening member 89 is adapted to seal against a surface 94 of the housing 86 by engaging against a sealing means 95 thereof carried by the housing means 86 as illustrated in FIG. 7. Of course, the end 91 of the fastening member 89 could seal against an O-ring seal (not shown) carried by the housing 86 in addition to the seal 97 or in lieu thereof, if desired. Likewise, the external peripheral surface 96 of the tubular member 22 of the switch construction 20 is adapted to seal against an annular O-ring-like sealing member 97 of the housing 86 that fluid seals the opening 84 in the tubular member 22 from the open end 23 thereof whereby the open end 23 is adapted to be disposed in fluid communication with the suction side or low pressure side of the lubricant system for the compressor 87 while the opening 84 is adapted to be disposed in fluid communication with a passage means 98 in the housing 86 that leads to the high pressure side or source of lubricating oil for the compressor 87.

In this manner, the differential pressure operated electrical switch construction 20 of this invention is adapted to be utilized in combination with the compressor 87 to protect the same from operating when there is insufficient oil pressure to lubricate the bearings thereof as will be apparent hereinafter.

If desired, the ends 35 and 36 of the terminals 28 and 29 can be electrically interconnected to leads 99 and 100 such as by soldering and the like and the interconnection between the ends 35 and 36 of the terminals 28 and 29 and the leads 99 and 100 can be encapsulated with suitable encapsulating material, such as a polyurethane material, and the same can then be covered with a polyvinylchloride cover 101 as illustrated in the drawings so that the leads 99 and 100 can be electrically interconnected into the desired electrical circuit, such as the electrical circuit (not shown) for controlling the electric motor of the compressor 87 so that the electric motor for the compressor 87 will only operate as long as the switch means 39 electrically interconnects the terminal member 28 and 29 together. However, when the switch means 39 is in an open condition thereof so that the terminals 28 and 29 are not electrically interconnected, the electrical motor that drives the compressor 87 cannot operate so that the bearings of the compressor 87 will not burn out by the failure of the lubricating system for the compressor 87 to provide sufficient oil pressure for lubricating such bearings as will be apparent hereinafter.

In order to prevent the switch blade 43 from being overstressed in the open condition thereof by the piston means 61 being moved too great a distance in the drawings by the force of the compression spring 74 overcoming the pressure differential acting across the piston means 61, a suitable stop 102, FIGS. 2 and 3, can be carried by the end plug 26 and have a rounded end 103 against which the medial portion 58 of the switch blade 43 will contact so as to prevent the switch blade 43 from being bent beyond a sufficient distance for its end 45 to be disposed away from the edge portion 50 of the terminal 29 when the switch means 39 is in its open condition. The stop 102 can comprise a metal pin having opposed cylindrical portions 104 and 105, the end 105 being adapted to be press fitted into an opening 106 formed in the end surface 32 of the end plug 26 and be positioned therein through sufficient calibrating means so that the end 103 will be properly positioned to permit the blade 43 to be moved to an open condition without overstressing the same.

When all of the parts previously described have been assembled together to form the switch construction 20 of this invention by the method previously set forth, the switch construction 20 can be readily calibrated by merely pushing in on the end plug 25 until the increased compressive force of the compression spring 74 causes the switch blade 43 to slightly open when a certain test pressure differential is acting across the piston means 61 in a manner well known in the art.

Also, by selecting springs 74 of different force ratings when making the switch constructions 20, the pressure differential required to act across the piston 61 to open the switch means 39 can be any desired pressure differential with all of the other parts of the switch construction being the same.

Thus, it can be seen that it is a relatively simple method of this invention to form the switch construction 20 which is adapted to operate in the manner now to be described.

When the differential pressure operated electrical switch construction 20 of this invention has been inserted into the passage means 85 of the compressor 87 and the leads 99 and 100 have been interconnected into the electrical circuit (not shown) of the electrical motor of compressor 87 so that the electrical motor for operating the compressor 87 will turn off when the switch means 39 is in an open condition and will operate when the switch 39 is in a closed condition, the compression spring 74 has been so chosen that the same will assure that when a certain differential pressure acts across the piston means 61, such differential pressure overcomes the force of the compression spring 74 and moves the piston means 61 against the conical end 81 of the plug 25 in the manner illustrated in FIG. 2 whereby the switch blade 43 moves by its natural resilience to its closed condition by having the end 45 disposed against the edge portion 50 of the terminal 29 to electrically interconnect the terminals 28 and 29 together.

For example, such certain differential pressure could be any pressure value over approximately 15 psig between the pressure value of the pressure fluid in the chamber 62 and the pressure value of the pressure fluid in the chamber 63. Of course, other certain pressure differentials could be selected depending upon the rate of the selected spring 74.

In any event, as long as the lubricating system of the compressor 87 is delivering lubricant at a proper pressure value, the resulting pressure differential acting across the piston 61 causes the piston 61 to be to the left so that the switch blade 43 has its end 45 in contact with the edge portion 50 of the terminal 29. However, should the pressure value of the lubricant being delivered by the lubricant system of the compressor 87 to the bearings thereof fall below a certain value so that the force of the compression spring 74 can move the piston means 61 to the right to have the end surface 59 thereof engage against the dimple 57 of the switch blade 43 and move the switch blade 43 to the right against the surface 103 of the stop 102 as illustrated in FIG. 3, the switch blade 43 is now disposed out of electrical contact with the terminal 29 and thereby prevents electrical flow between the terminals 28 and 29 so that the electric motor for the compressor 87 is in an inoperative condition and the compressor 87 will not be operated with the lubricant at the low pressure value thereof which would cause the bearings thereof to be adversely affected.

Therefore, it can be seen that the switch 39 is a relatively slow make and break switch and the end 45 of the switch blade 43, as well as the edge means 50 of the terminal 29, can be gold plated to provide for dry circuit switching in the oil in the chamber 63. For example, such gold plating can be approximately 0.000050 of an inch in thickness.

It has been found that by making the switch blade 43 relatively wide and relatively long and having the same operating in oil in the chamber 63 in the manner previously described, vibrations caused by the operation of the compressor 87 do not cause contact chatter because the oil in the chamber 63 acting on such large surface areas of the switch blade 43 acts as a fluid dampener to prevent contact chatter.

Also, it has been found that by utilizing the encapsulating insulating material and cover 101 as illustrated in FIGS. 1 and 7, the unit 20 is substantially "rainproofed".

Accordingly, it can be seen that the improved differential pressure operated electrical switch construction 20 of this invention is adapted to function in the same manner as the pressure responsive magnetic switch construction set forth in the aforementioned U.S. Pat. No. 3,924,086, whereby this patent is being incorporated into this disclosure by this reference thereto, while not having capillaries which are a source for failure through the easy breaking thereof and that the switch construction 20 of this invention is easily pressed into the bore of the casting of the compressor 87 to be sealed by suitable O-rings or other sealing means in such casting.

It has been found that a maximum steady state temperature of the compressor 87 will run about 160° F. with intermittent temperatures up to 250° F. and that such temperatures do not adversely affect the operation of the switch construction 20 of this invention.

Accordingly, it can be seen that this invention not only provides an improved differential pressure operated electrical switch construction and method of making the same, but also this invention provides an improved combination of such a switch construction and a compressor.

While the forms and methods of this invention now preferred have been illustrated and described as required by the Patent Statute, it is to be understood that other forms and method steps can be utilized and still fall within the scope of the appended claims.

What is claimed is:

1. In a differential pressure operated electrical switch construction having a housing means carrying a pair of rigid substantially straight parallel terminals and an electrical switch means for electrically interconnecting said terminals together when said switch means is in one operating condition thereof and for electrically disconnecting said terminals from each other when said switch means is in another operating condition thereof, said housing means having actuator means responsive to differential pressures acting across the same and being operatively associated with said switch means to place said switch means in said one condition thereof when having a certain differential pressure acting across the same and to place said switch means in said other condition thereof when having another certain differential pressure acting across the same, the improvement wherein one of said terminals has an end provided with a substantially rectangular opening passing transversely and completely therethrough and defining a substantially straight interior edge means of said one terminal, said switch means comprising a movable switch blade having one end carried by the other of said terminals and having another end disposed in said opening for engaging against said edge means and thereby place said switch means in said one condition thereof and for being out of engagement with said edge means and thereby place said switch means in said other condition thereof.

2. An electrical switch construction as set forth in claim 1 wherein said housing means has two chambers therein that are separated by said actuator means and are respectively adapted to receive pressure fluid therein having different pressure values to provide said differential pressure acting across said actuator means, said switch blade being disposed in one of said chambers so as to be exposed to the fluid therein.

3. An electrical switch construction as set forth in claim 2 wherein said actuator means comprises a movable piston disposed in said housing means and having opposed ends respectively exposed to said chambers, one of said ends being engageable with said switch blade to cause movement thereof.

4. An electrical switch construction as set forth in claim 3 wherein a stop is carried by said housing means and is adapted to be engaged by said switch blade when said switch blade is moved by said piston to place said switch means in said other operating condition thereof.

5. An electrical switch construction as set forth in claim 4 wherein said housing means comprises a tubular member having opposed open ends and an electrically insulating plug member disposed in one of said ends of said tubular member to close the same, said plug member carrying said terminals.

6. An electrical switch construction as set forth in claim 5 wherein said plug member carries said stop.

7. An electrical switch construction as set forth in claim 6 wherein said stop comprises a pin having a rounded end against which said switch blade is adapted to be moved.

8. In the combination of a compressor having a housing and a differential pressure operated electrical switch construction for controlling the operation of said compressor and having a housing means carrying a pair of rigid substantially straight parallel terminals and an electrical switch means for electrically interconnecting said terminals together when said switch means is in one operating condition thereof to permit said compressor to operate and for electrically disconnecting said terminals from each other when said switch means is in another operating condition thereof to terminate operation of said compressor, said housing of said compressor having a passage means therein, said housing means being secured in said passage means, said housing means having actuator means responsive to differential pressures acting across the same caused by the low pressure side and high pressure side of the lubricant system for said compressor and being operatively associated with said switch means to place said switch means in said one condition thereof when having a certain differential pressure acting across the same and to place said switch means in said other condition thereof when having another certain differential pressure acting across the same, the improvement wherein one of said terminals has an end provided with a substantially rectangular opening passing transversely and completely therethrough defining a substantially straight interior edge means of said one terminal, said switch means comprising a movable switch blade having one end carried by the other of said terminals and having another end disposed in said opening for engaging against said edge means and thereby place said switch means in said one condition thereof and for being out of engagement with said edge means and thereby place said switch means in said other conditon thereof.

9. A combination as set forth in claim 8 wherein said housing means has two chambers therein that are separated by said actuator means and are respectively adapted to receive pressure fluid therein from said low pressure side and said high pressure side of said lubricant system of said compressor to provide said differential pressure acting across said actuator means, said switch blade being disposed in one of said chambers that receives said high pressure therein so as to be exposed to the lubricant therein.

10. A combination as set forth in claim 9 wherein said actuator means comprises a movable piston disposed in said housing means and having opposed ends respectively exposed to said chambers, one of said ends being engageable with said switch blade to cause movement thereof.

11. A combination as set forth in claim 10 wherein a stop is carried by said housing means and is adapted to be engaged by said switch blade when said switch blade is moved by said piston to place said switch means in said other operating condition thereof.

12. A combination as set forth in claim 11 wherein said housing means comprises a tubular member having opposed open ends and an electrically insulating plug member disposed in one of said ends of said tubular member to close the same, said plug member carrying said terminals.

13. A combination as set forth in claim 12 wherein said plug member carries said stop.

* * * * *